US006726123B2

(12) United States Patent
Wang

(10) Patent No.: US 6,726,123 B2
(45) Date of Patent: Apr. 27, 2004

(54) OPERATING/CONTROLLING STRUCTURE OF DETERGENT-MIXABLE SPRINKLING GUN

(75) Inventor: King Yuan Wang, Changhua Hsien (TW)

(73) Assignee: Yuan Mei Corp., Chunghua Hsien (TW)

( * ) Notice: Subject to any disclaimer, the term of this patent is extended or adjusted under 35 U.S.C. 154(b) by 265 days.

(21) Appl. No.: 10/035,120

(22) Filed: Jan. 4, 2002

(65) Prior Publication Data

US 2003/0127537 A1 Jul. 10, 2003

(51) Int. Cl.[7] ..... B05B 7/26

(52) U.S. Cl. ..... 239/310; 239/318; 239/394; 239/526; 239/581.1

(58) Field of Search ..... 239/310, 318, 239/407, 525, 390, 394, 581.1, 526

(56) References Cited

U.S. PATENT DOCUMENTS

| | | | | |
|---|---|---|---|---|
| 3,254,844 A | * | 6/1966 | Blasnik et al. | 239/318 |
| RE29,405 E | * | 9/1977 | Gunzel, et al. | 239/318 |
| 5,881,955 A | * | 3/1999 | Styne | 239/310 |
| 6,378,785 B1 | * | 4/2002 | Dodd | 239/318 |

* cited by examiner

*Primary Examiner*—Steven J. Ganey
(74) *Attorney, Agent, or Firm*—Bacon & Thomas, PLLC

(57) ABSTRACT

Operating/controlling structure of detergent-mixable sprinkling gun, including a gun body, a sprinkling head, a connecting body connected between the gun body and the sprinkling head, a valve seat, an operating/controlling member, a locking bolt and a detergent barrel. The water flows into the gun body and then flows out from the sprinkling head. The connecting body has a seat body formed with a seat tube and a seat sink connected therewith by a stop board. A spring pin is fitted in the seat sink. The seat tube communicates with an outlet and an inlet. The outlet and inlet respectively communicate with two communicating holes. The valve seat has a circular boss. A valve shaft upward extends from the circular boss. The center of the top of the valve shaft is formed with a through hole. A semicircle of the top of the valve shaft is formed with several engaging cuts. A gate body is disposed between the valve shaft and the circular boss. The circumference of body of the valve seat is formed with two groups of through holes with different sizes opposite to each other. The operating/controlling member is cap-like. The bottom of the operating/controlling member is formed with a fitting post. The inner circumference of the fitting post is formed with several ribs. The bottom face of the operating/controlling member is formed with several locating dents. A guiding groove is formed on the bottom face and adjacent to the locating dents. A stop block is formed on the bottom face. The detergent barrel is screwed into the inner thread of the seat body.

4 Claims, 6 Drawing Sheets

OPERATING/CONTROLLING STRUCTURE OF DETERGENT-MIXABLE SPRINKLING GUN

BACKGROUND OF THE INVENTION

The present invention is related to an operating/controlling structure of detergent-mixable sprinkling gun in which an operating/controlling member is adjustable to drive a gate body of the valve seat to rotate within the seat tube of the connecting body. The spring pin in the seat sink of the connecting body extends into and abuts against the guiding groove of the operating/controlling member. By means of controlling the extent to which the outlet of the connecting body is obstructed by the gate body, the amount of the clean water discharged from the inlet and the sprinkling head can be micro-adjusted. The spring pin in the seat sink of the connecting body can be located in any of the locating dents of the bottom face of the operating/controlling member as necessary. Under such circumstance, the gate body of the valve seat does not obstruct the outlet of the connecting body and the clean water is mixed with the detergent and then the mixture is sprinkled out from the sprinkling head. The amount of the mixture of clean water and detergent can be also controlled by a user.

FIGS. 1 and 2 show an operating/controlling structure of a conventional detergent-mixable sprinkling gun. The sprinkling gun includes a gun body 1 for a user's hand to hold, a sprinkling head 2 for sprinkling water in figured pattern and a connecting body 3 connected between the gun body 1 and the sprinkling head 2. The connecting body 3 has longitudinal and transverse passages communicating with each other. An adjustment seat 4 is downward fitted into the longitudinal passage. The adjustment seat 4 has a threaded post 4', two through holes 4" and a tunnel 4'". An operating/controlling member 5 having a handle is fitted with the threaded post 4' of the adjustment seat 4. A bolt 5" is passed through a hole 5' of the handle and screwed into the threaded post 4' of the adjustment seat 4. A detergent barrel 6 having outer thread is screwed with inner thread of a skirt 3' of lower side of the connecting body 3.

The above conventional structure has some shortcomings as follows:

1. When clean water flows into the gun body 1, a user can via the operating/controlling member 5 operates the adjustment seat 4 to align the tunnel 4'" with the inlet. Under such circumstance, the clean water can be sprinkled out from the sprinkling head 2. However, the amount of the sprinkled clean water cannot be controlled so that the water is wasted.
2. When the tunnel 4'" of the adjustment seat 4 is not aligned with the inlet and shut off, the two through holes 4" of the adjustment seat 4 are just aligned with two apertures 3" formed on the bottom of the transverse passage of the connecting body 3. Under such circumstance, a part of the clean water will flow into the detergent barrel 6 and then flow out with the detergent from the sprinkling head 2. When a great amount of detergent is necessary, it takes a lot of time to make the necessary detergent flow out.
3. The amount of the discharged clean water is constant and can be hardly adjusted. Therefore, such sprinkling gun is not usable in gardening to water slender plants or flowers.

SUMMARY OF THE INVENTION

It is therefore a primary object of the present invention to provide an operating/controlling structure of detergent-mixable sprinkling gun in which an operating/controlling member is Adjustable to drive a gate body of the valve seat to rotate within the seat tube of the connecting body. A spring pin in the seat sink of the connecting body can be located in any of the locating dents of the bottom face of the operating/controlling member as necessary. Under such circumstance, the clean water is mixed with the detergent and then the mixture is sprinkled out from the sprinkling head. The amount of the mixture of clean water and detergent can be also controlled by a user.

It is a further object of the present invention to provide the above operating/controlling structure of detergent-mixable sprinkling gun in which an operating/controlling member is adjustable to drive a gate body of the valve seat to rotate within the seat tube of the connecting body. The spring pin in the seat sink of the connecting body extends into and abuts against the guiding groove of the operating/controlling member. By means of controlling the extent to which the outlet of the connecting body is obstructed by the gate body, the amount of the clean water discharged from the inlet and the sprinkling head can be micro-adjusted.

The present invention can be best understood through the following description and accompanying drawings wherein:

DETAILED DESCRIPTION OF THE PREFERRED EMBODIMENT

Figure 1:
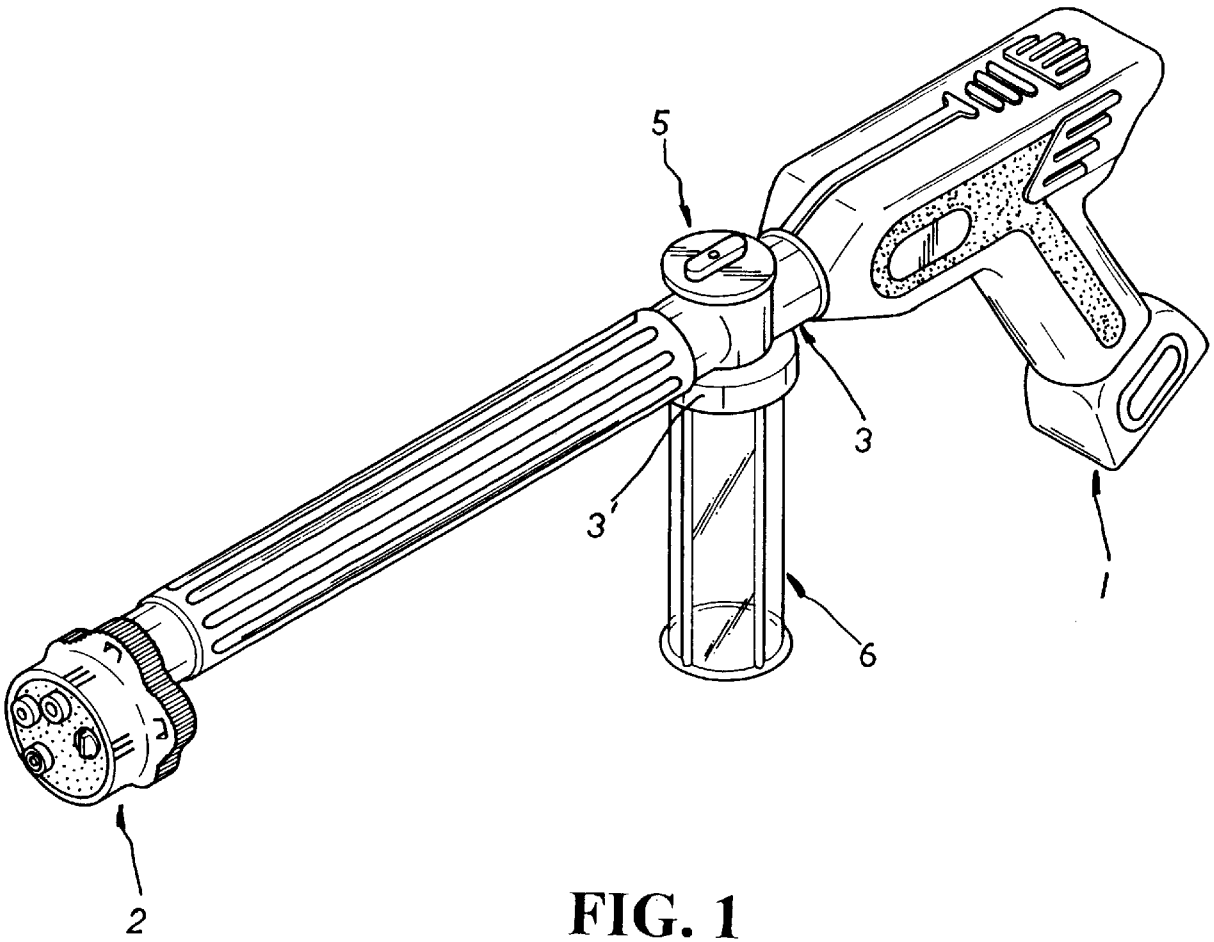
FIG. 1 PRIOR ART
FIG. 1 is a perspective assembled view of an operating/controlling structure of a conventional detergent-mixable sprinkling gun.
Figure 2:
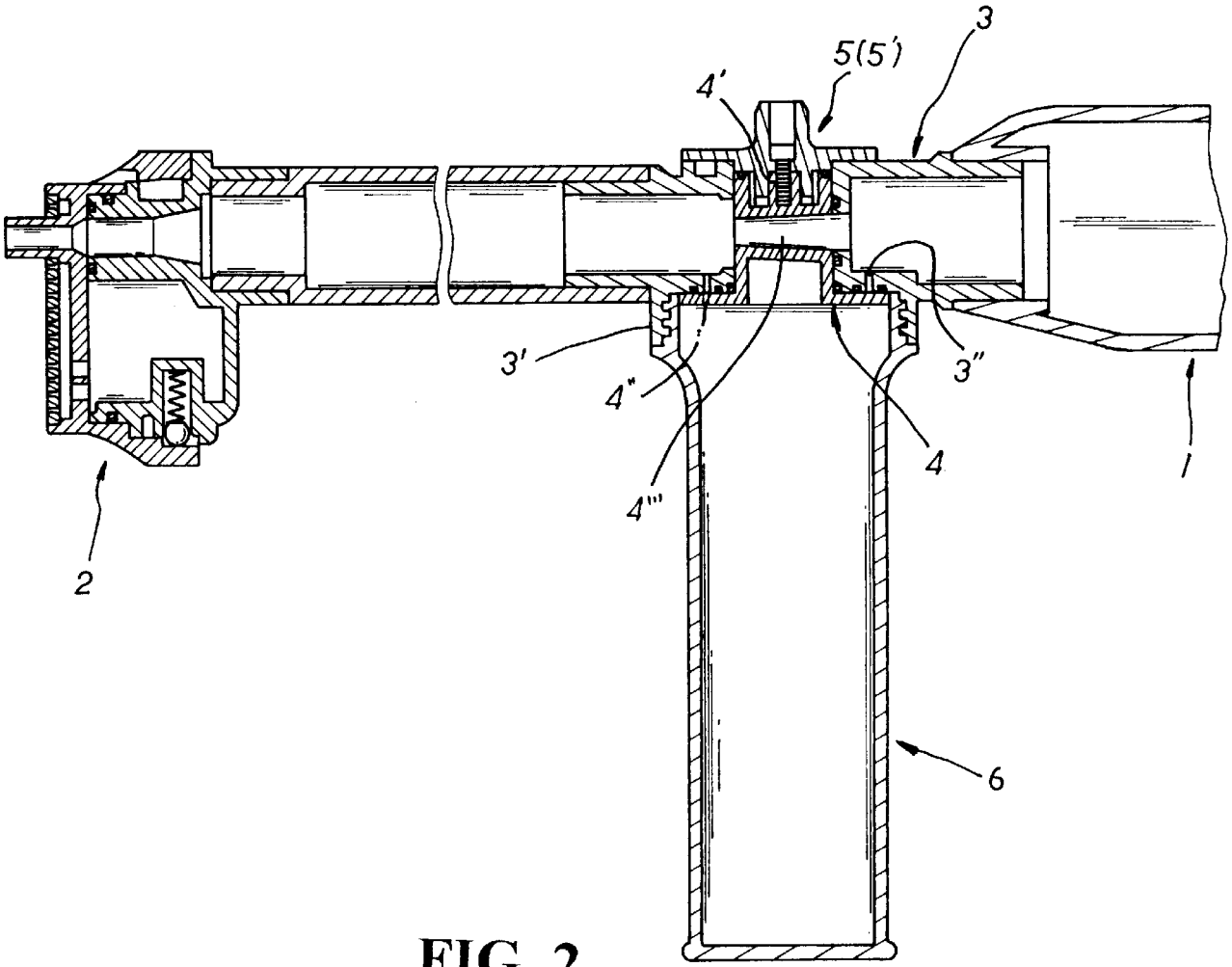
FIG. 2 PRIOR ART
FIG. 2 is a sectional assembled view of the operating/controlling structure of the conventional detergent-mixable sprinkling gun.
Figure 3:
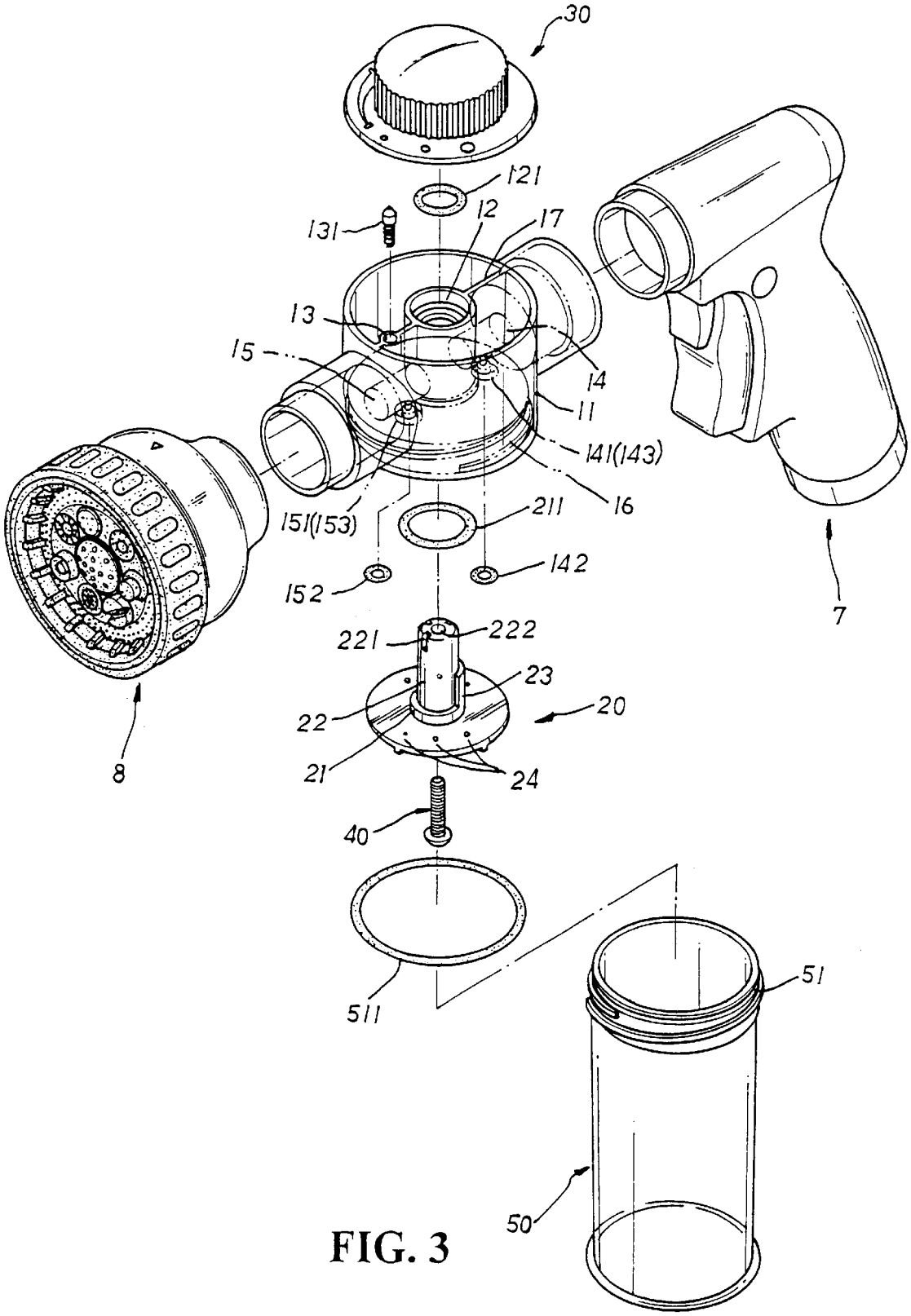
FIG. 3 is a perspective exploded view of the operating/controlling structure of the present invention.

Please refer to FIG. 3. The present invention includes a gun body 7, a sprinkling head 8, a connecting body 10, a valve seat 20, an operating/controlling member 30, a locking bolt 40, a detergent barrel 50 and several watertight rings 121, 142, 152, 211, 511. The water flows into the gun body 7 and then flows out from the sprinkling head 8. The sprinkling head 8 has various water discharging patterns. The connecting body 10 has a seat body 11 formed with a seat tube 12 and a seat sink 13 connected therewith by a stop board 17. The opening of the seat tube 12 is stepped and a spring pin 131 is fitted in the seat sink 13. The seat tube 12 communicates with an outlet 14 and an inlet 15. The outlet 14 communicates with a communicating hole 141. An annular groove 143 is formed around the communicating hole 141 and a watertight ring 142 is fitted in the annular groove 143. The inlet 15 communicates with a communicating hole 151. An annular groove 153 is formed around the communicating hole 151 and a watertight ring 152 is fitted in the annular groove 153. The inner circumference of the bottom of the seat body 11 is formed with an inner thread 16.

Figure 4:
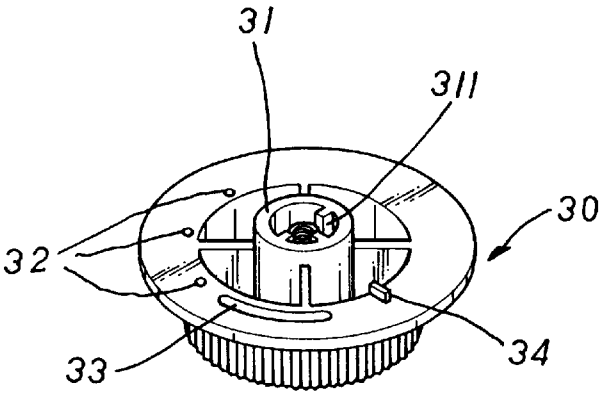
FIG. 4 is a back perspective view of the operating/controlling member of the present invention.

The valve seat 20 has a circular boss 21 at the center. A valve shaft 22 upward extends from the circular boss 21 by a certain length. The center of the top of the valve shaft 22 is formed with a through hole 222. A semicircle of the top of the valve shaft 22 is formed with several engaging cuts 221 at equal intervals. A gate body 23 is disposed between the valve shaft 22 and the circular boss 21. The circumference of body of the valve seat 20 is formed with two groups of through holes 24 at equal intervals with different sizes. The two groups of through holes 24 are arranged opposite to each other. The operating/controlling member 30 is cap-like (with reference to FIG. 4). The center of the bottom of the operating/controlling member 30 is formed with a fitting post 31 having a threaded post. The inner circumference of the fitting post 31 is formed with several ribs 311 at equal intervals. In addition, the bottom face of the operating/controlling member 30 is formed with several locating dents 32 along the inner circumference thereof and arranged at equal intervals. A guiding groove 33 with a certain length is formed on the bottom face adjacent to the locating dents 32. A stop block 34 is formed on the bottom face in a certain position. The upper end of the detergent barrel 50 is formed with an outer thread 51. A watertight ring 511 is fitted around the opening of the detergent barrel 50. When assembled, the gun body 7 and the sprinkling head 8 are fixedly connected with the outlet 14 and the inlet 15 of the connecting body 10. A watertight ring 211 is fitted around the circular boss 21 of the valve seat 20 and then the valve shaft 22 thereof is fitted into the seat tube 12 from the bottom face of the seat body 11 of the connecting body 10. Two watertight rings 141, 151 are fixed between the bottom face of the seat body 11 and the body of the valve seat 20. The ribs 311 of the central fitting post 31 of the operating/controlling member 30 are engaged with the engaging cuts 221 of the top of the valve shaft 22. The stop block 34 of the operating/controlling member is movable within one side of the stop board 17 of the connecting body 10 and serves to lean against and stop the stop board 17. The locking bolt 40 is upward passed through the through hole 222 of the valve shaft 22 and locked on the fitting post 31 of the operating/controlling member 30. The spring pin 131 is restricted between the seat sink 13 of the connecting body 10. Then, the detergent barrel 50 is screwed into the inner thread 16 of the bottom of the seat body 11 to complete the assembly.

Figure 5:
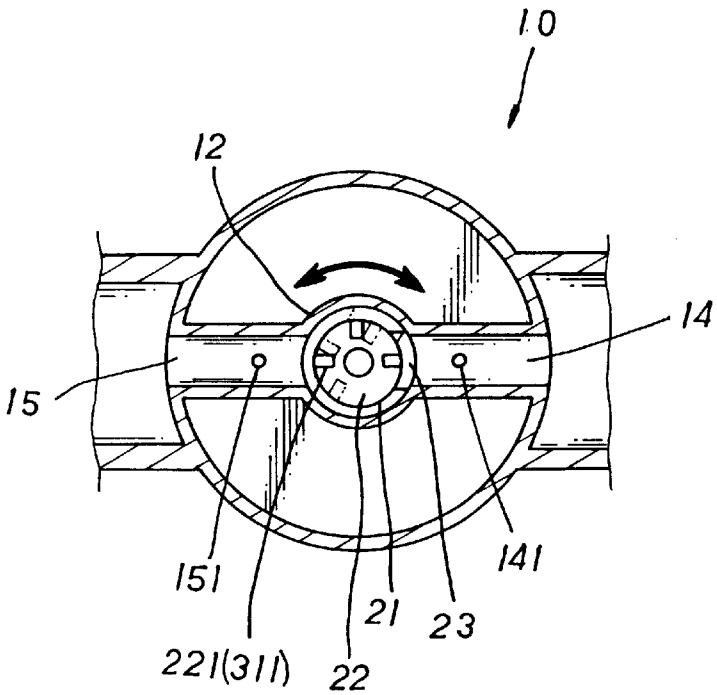
FIG. 5 shows the operation of the present invention for discharging clean water.

When using clean water (as shown in FIG. 5), the operating/controlling member 30 is adjusted to drive the gate body 23 of the valve seat 20 to rotate within the seat tube 12 of the connecting body 10. The spring pin 131 in the seat sink 13 of the connecting body 10 extends into and abuts against the guiding groove 33. By means of controlling the extent to which the outlet 14 of the connecting body 10 is obstructed by the gate body 23, the amount of the clean water discharged from the inlet 15 and the sprinkling head 8 can be micro-adjusted.

Figure 6:
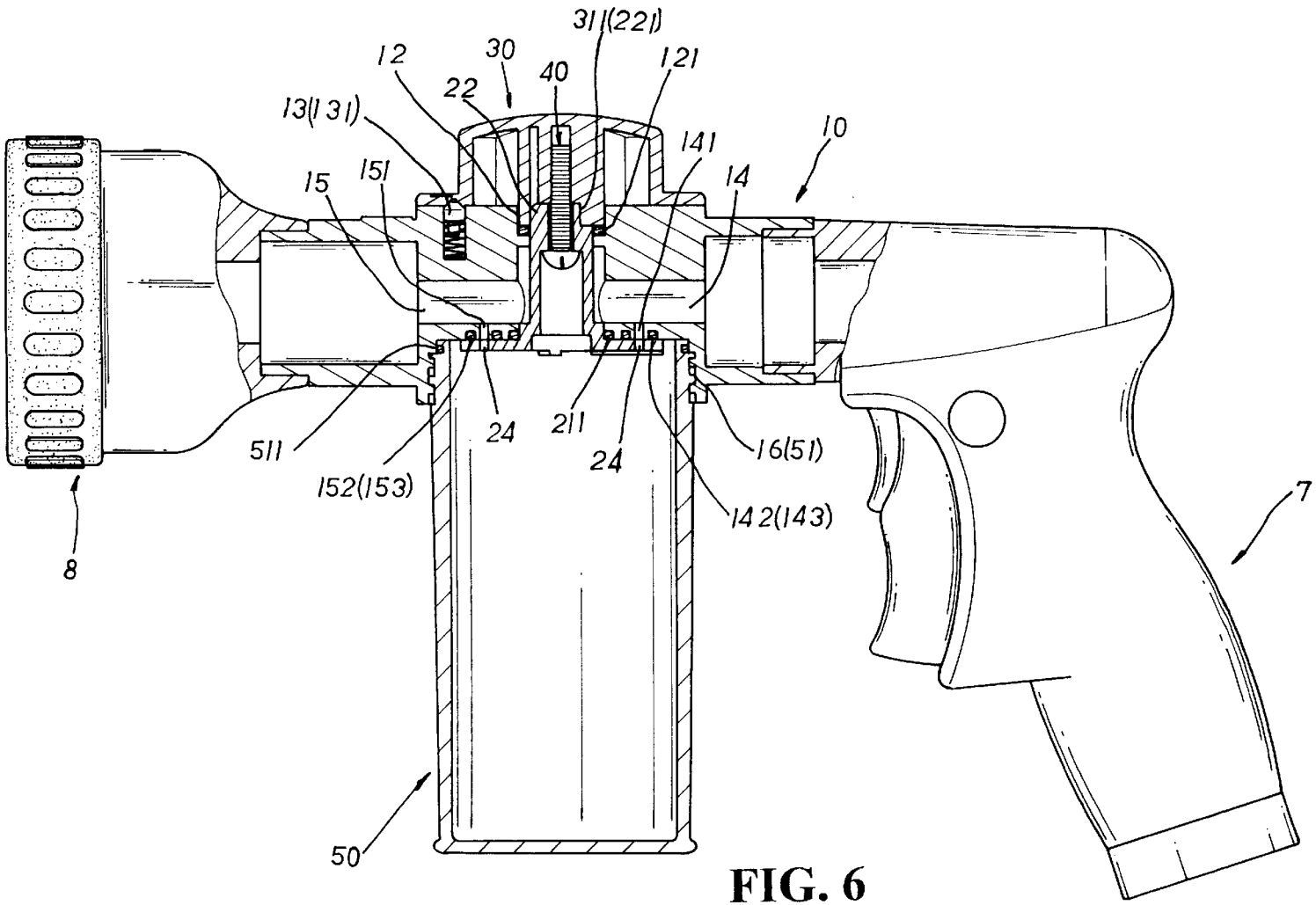
FIG. 6 is a sectional assembled view of the operating/controlling structure of the present invention.
Figure 7:
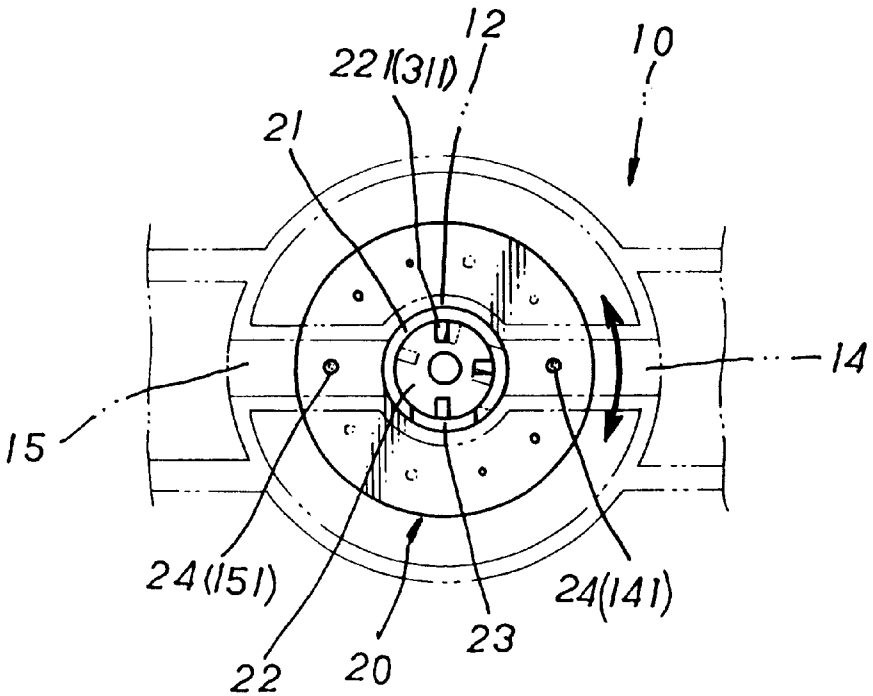
FIG. 7 is a top view showing the operation of the present invention for discharging mixture of clean water and detergent.

When using detergent (as shown in FIGS. 6 and 7) of the valve seat 20 to rotate within the seat tube 12 of the connecting body 10. The spring pin 131 in the seat sink 13 of the connecting body 10 can be located in any of the locating dents 32 of the bottom face of the operating/controlling member 30 as necessary. Under such circumstance, the gate body 23 of the valve seat 20 does not obstruct the outlet 15 of the connecting body 10. A part of the clean water gets into the detergent barrel 50 through the communicating hole 141 which communicates with the outlet 14 and through the through hole 24 of the valve seat 20. The clean water is mixed with the detergent and then flows into the inlet 15 through the through hole 24 of the valve seat 20 and the communicating hole 151 which communicates with the inlet 14 into the inlet 15. In the inlet 15, the clean water is further mixed with the detergent and then the mixture of the clean water and detergent is sprinkled out from the sprinkling head 8.

The above embodiment is only used to illustrate the present invention, not intended to limit the scope thereof. Many modifications of the above embodiment can be made without departing from the spirit of the present invention.

What is claimed is:

1. Operating/controlling structure of detergent-mixable sprinkling gun, comprising a gun body, a sprinkling head, a connecting body connected between the gun body and the sprinkling head, a valve seat, an operating/controlling member, a locking bolt, a detergent barrel, a locking bolt being upward passed through a through hole of a valve seat to lock the valve seat with the operating/controlling member, permitting water flowing into the gun body and then flowing through the connecting body and then flowing out from the sprinkling head, the connecting body being formed with an inner thread, the detergent barrel being formed with an outer thread and provided with a first watertight ring, the detergent barrel being screwed in the inner thread of the connecting body, the sprinkling head having various water discharging patterns, each of the outlet and inlet of the connecting body communicating with a communicating hole, a second watertight ring being fitted in an annular groove formed around the communicating hole, said operating/controlling structure being characterized in that:

the connecting body has a seat body formed with a seat tube, a seat sink and a stop board connecting the seat tube with the seat sink, two ends of the seat body being respectively connected with the gun body and the sprinkling head, the seat tube communicating with the outlet and the inlet;

the valve seat has a circular boss at the center of the body of the valve seat, a valve shaft extending upwardly from the circular boss by a certain length, a gate body being disposed between the valve shaft and the circular boss, the circumference of the valve seat being formed with two groups of through holes of different sizes and at equal intervals, the two groups of through holes being arranged opposite to each other; and the operating/controlling member is of a cap-like configuration, the center of the bottom of the operating/controlling member being formed with a fitting post having a threaded post, a bottom face of the operating/controlling member being formed with several locating dents along an inner circumference thereof and arranged at equal intervals, and a guiding groove having a certain length formed on the bottom face adjacent to the locating dents.

2. Operating/controlling structure of detergent-mixable sprinkling gun as claimed in claim 1, wherein the inner circumference of the opening of the seat tube of the connecting body has a stepped section on which a third watertight ring is disposed, a spring pin being fitted in the seat sink to extend into and resiliently abut against any of the locating dents or the guiding groove of the operating/controlling member.

3. Operating/controlling structure of detergent-mixable sprinkling gun as claimed in claim 1, wherein a semicircle of the top of the valve shaft is formed with several engaging cuts at equal intervals, a half of inner circumference of the fitting post being formed with several ribs at equal intervals, the ribs of the fitting post being engaged with the engaging cuts of the top of the valve shaft.

4. Operating/controlling structure of detergent-mixable sprinkling gun as claimed in claim 1, wherein a stop block is formed on the circumference of bottom face of the operating/controlling member, the stop block of the operating/controlling member being movable within one side of the stop board of the connecting body and serving to lean against and stop the stop board.

* * * * *